US007271796B1

(12) United States Patent
Moll et al.

(10) Patent No.: US 7,271,796 B1
(45) Date of Patent: Sep. 18, 2007

(54) RECONFIGURABLE CONTROL FOR A COMBAT VEHICLE

(75) Inventors: Robert E. Moll, Fairfield, CT (US); Steven Cai, Orange, CT (US)

(73) Assignee: Ultra Electronics Measurement Systems, Inc., Wallingford, CT (US)

( * ) Notice: Subject to any disclaimer, the term of this patent is extended or adjusted under 35 U.S.C. 154(b) by 596 days.

(21) Appl. No.: 10/900,564

(22) Filed: Jul. 28, 2004

(51) Int. Cl.
*G09G 5/08* (2006.01)

(52) U.S. Cl. ..... 345/161; 345/156; 434/45; 244/234

(58) Field of Classification Search ..... 345/156–169; 74/523; 244/220–221, 234, 228–229
See application file for complete search history.

(56) References Cited

U.S. PATENT DOCUMENTS

| | | | | |
|---|---|---|---|---|
| RE24,701 | E | 9/1959 | Redmond | 318/19 |
| 3,198,922 | A | 8/1965 | Rohacs | 200/157 |
| 3,678,439 | A | 7/1972 | Vetter | 339/46 |
| 3,953,099 | A | 4/1976 | Wilson | 339/60 |
| 4,085,301 | A | 4/1978 | Smith | 200/4 |
| 4,802,861 | A | 2/1989 | Gaston | 439/247 |
| 5,472,156 | A | 12/1995 | Bivens, III et al. | 244/234 |
| 5,607,158 | A | 3/1997 | Chan | 273/148 |
| 5,727,423 | A | 3/1998 | Torii et al. | 74/473 |
| 5,738,352 | A * | 4/1998 | Ohkubo et al. | 273/148 B |
| 6,788,291 | B2 * | 9/2004 | Burry | 345/161 |
| 2003/0189547 | A1 * | 10/2003 | Lee et al. | 345/161 |

FOREIGN PATENT DOCUMENTS

| | | |
|---|---|---|
| JP | 06051855 A | 2/1994 |

* cited by examiner

*Primary Examiner*—Richard Hjerpe
*Assistant Examiner*—Mansour M. Said
(74) *Attorney, Agent, or Firm*—Wiggin and Dana LLP; Gregory S. Rosenblatt; Anthony P. Gangemi

(57) ABSTRACT

A reconfigurable control for a combat vehicle such as a tank, personnel carrier, or aircraft, is presented. The control includes a grip, a base and a seal. The grip has a lower surface and a chamber. The grip includes a first electrical connector and a key located within the chamber. The base has an upper surface and a shaft. The base includes a second electrical connector and a keyway. In an installed position, the shaft is located within the chamber such that the grip's lower surface and the base's upper surface are substantially coplanar, the first connector electrically engages the second connector, the key mechanically engages the keyway, and the seal facilitates a compression fit between the grip and the base for sealing the chamber such that at least one of contaminants are prevented from entering the chamber and noise vibration rattle is eliminated.

8 Claims, 4 Drawing Sheets

RECONFIGURABLE CONTROL FOR A COMBAT VEHICLE

BACKGROUND OF THE INVENTION

1. Field of the Invention

The present invention relates generally to manual control devices, typically referred to as joysticks, for use in controlling a combat vehicle and, more particularly, to a reconfigurable control for a combat vehicle.

2. Description of Prior Art

Manual control devices, typically referred to as joysticks, are used in various apparatus such as, for example, video games, heavy construction equipment, aircraft and combat vehicles to control and/or activate features and functions of the apparatus such as position, velocity and acceleration. Generally speaking, joysticks have a base and a shaft disposed in and extending from the base. The shaft has a handle at one end and components at an opposing end of the shaft that is disposed in the base. Buttons are mounted in the handle. When depressed, the buttons generate electrical signals for activating desired functions of the apparatus being controlled with the joystick. The components interact with one or more sensors located in the base such that movement of the shaft (e.g., displacement of the handle) is translated by the sensors into electrical signals for actuating a desired response from the apparatus.

Joysticks are typically customized to control a specific apparatus. As such, joysticks tend to be installed in an assembly that is mounted to a console of the apparatus. For example, U.S. Pat. No. 5,472,156, titled "AIR COMBAT COLLECTIVE CONTROL HEAD," issued Dec. 5, 1995, to Courtland C. Bivens, III, et al. describes one such control. Another type of joystick assembly is described in U.S. Pat. No. 5,607,158, titled "DETACHABLE JOYSTICK HANDLE," issued Mar. 4, 1997, to Wah L. Chan, which describes a handle that is detachably mounted to a shaft. For example, Chan describes a joystick assembly where it is possible to change one handle for a different sized or shaped handle, or a handle having a different number or array of function buttons. The disclosures of these U.S. patent documents are incorporated by reference herein in their entireties.

The inventors have realized a number of deficiencies in conventional joystick type controllers. For example, joysticks used with computer video games and construction equipment may not be suitable for use as a displacement control for combat fighting vehicles such as, for example, a tank or armored personnel carrier. Conventional joysticks are ill equipped to address harsh environmental conditions of combat wherein dust, dirt and other contaminates eventually invade the housing of conventional joysticks and render mechanical and electrical components of the controller inoperable. Additionally, conventional joystick assemblies are not adaptable for changing mission requirements. As such, entire control assemblies must be replaced to accommodate expanding mission requirements.

Accordingly, the inventors have realized that a need exists for a reconfigurable combat controller that reliably minimizes the effects of contamination of components of the controller and for a controller that can be reconfigured for expanded mission requirements.

SUMMARY OF THE INVENTION

The above and other needs are addressed by a reconfigurable control for a combat vehicle such as, for example, a tank, personnel carrier, and aircraft, as described herein. The reconfigurable controller includes a grip, a base and a seal. The grip has a lower surface and a chamber extending from the lower surface, and includes a first electrical connector and a key located within the chamber. The base has an upper surface and a shaft extending from the upper surface, and includes a second electrical connector adapted to receive the first electrical connector and a keyway slot adapted to receive the key. The seal is located about the shaft of the base. In an installed position, the shaft of the base is located within the chamber of the grip such that the lower surface of the grip and the upper surface of the base are substantially coplanar. In the installed position, the first electrical connector electrically engages the second electrical connector, the key mechanically engages the keyway slot, and the seal forms a compression fit between the grip and the base for sealing the chamber such that contaminants are substantially prevented from entering the chamber and rendering mechanical and electrical components of the controller inoperable.

BRIEF DESCRIPTION OF THE DRAWINGS

The features and advantages of the present invention are better understood when the Detailed Description of the Preferred Embodiments given below is considered in conjunction with the figures provided, wherein.

In these figures, like structures are assigned like reference numerals, but may not be referenced in the description for all figures.

DETAILED DESCRIPTION OF THE PREFERRED EMBODIMENTS

Figure 1:
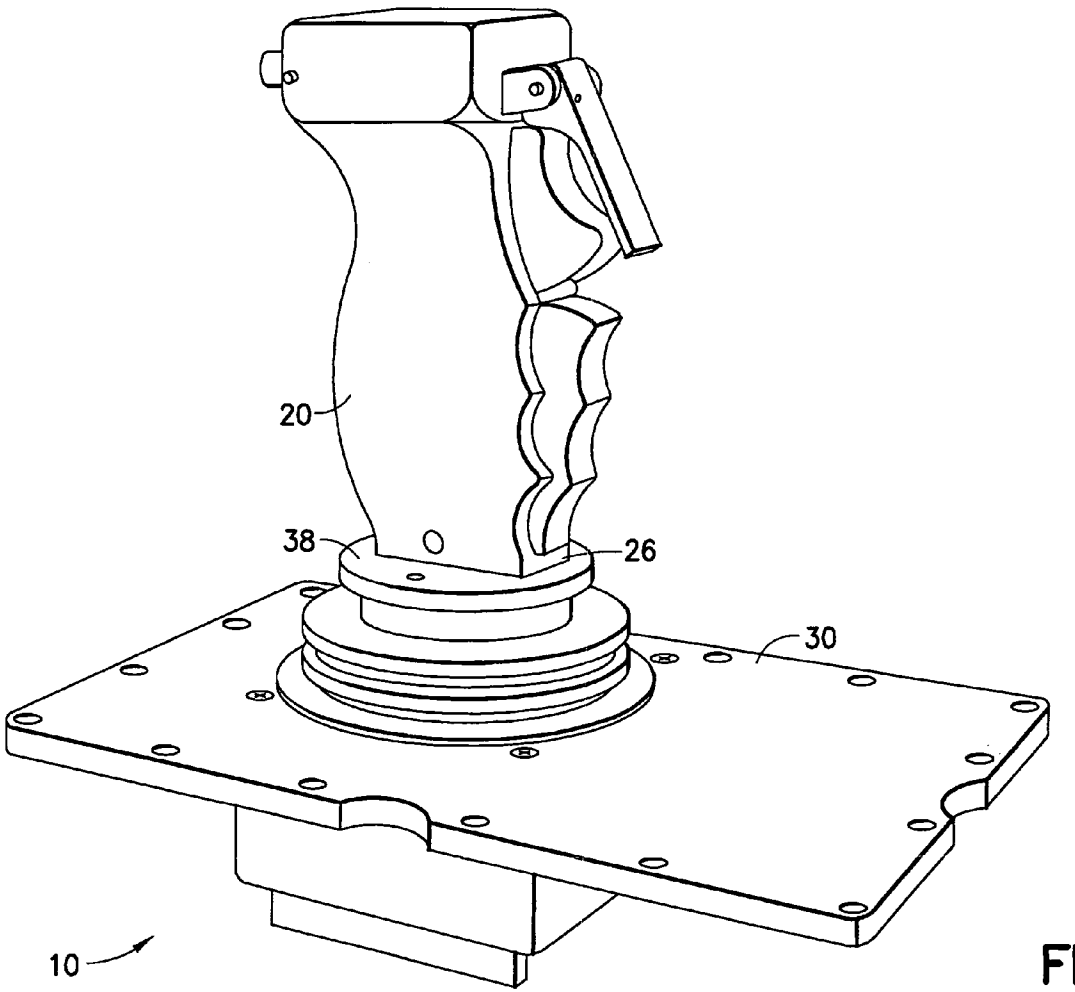
FIG. 1 is an elevational view of a reconfigurable control for combat vehicles configured and operating in accordance with one embodiment of the present invention.

FIG. 1 illustrates a reconfigurable control for a combat vehicle 10 (hereinafter referred to a reconfigurable combat controller) operating in accordance with one embodiment of the present invention. In one embodiment, the reconfigurable controller 10 is comprised of a Hall Effect displacement controller as described in commonly assigned, U.S. Pat. No. 5,850,142, titled "CONTROL DEVICE HAVING A MAGNETIC COMPONENT WITH CONVEX SURFACES," issued Dec. 15, 1998, to Chris P. Rountos et al. The disclosure of this U.S. patent document is incorporated by reference as if fully set forth herein.

As shown in FIG. 1, the reconfigurable combat controller 10 includes a grip 20 and a base 30. As shown more particularly in FIGS. 2 and 3, the grip 20 includes a male electrical connector 22 such as, for example, a 0.050 mil pitch, pre-wired "D" circular pin connector commercially available in five (5), twelve (12) and twenty-seven (27) (shown) pin and socket combinations. The grip 20 also includes a key 24 such as, for example, a press fit dowel pin, located to facilitate orientation of the grip 20 in the base 30 and to substantially inhibit, once mounted thereto, rotation of the grip 20 independently from the base 30.

Figure 2:
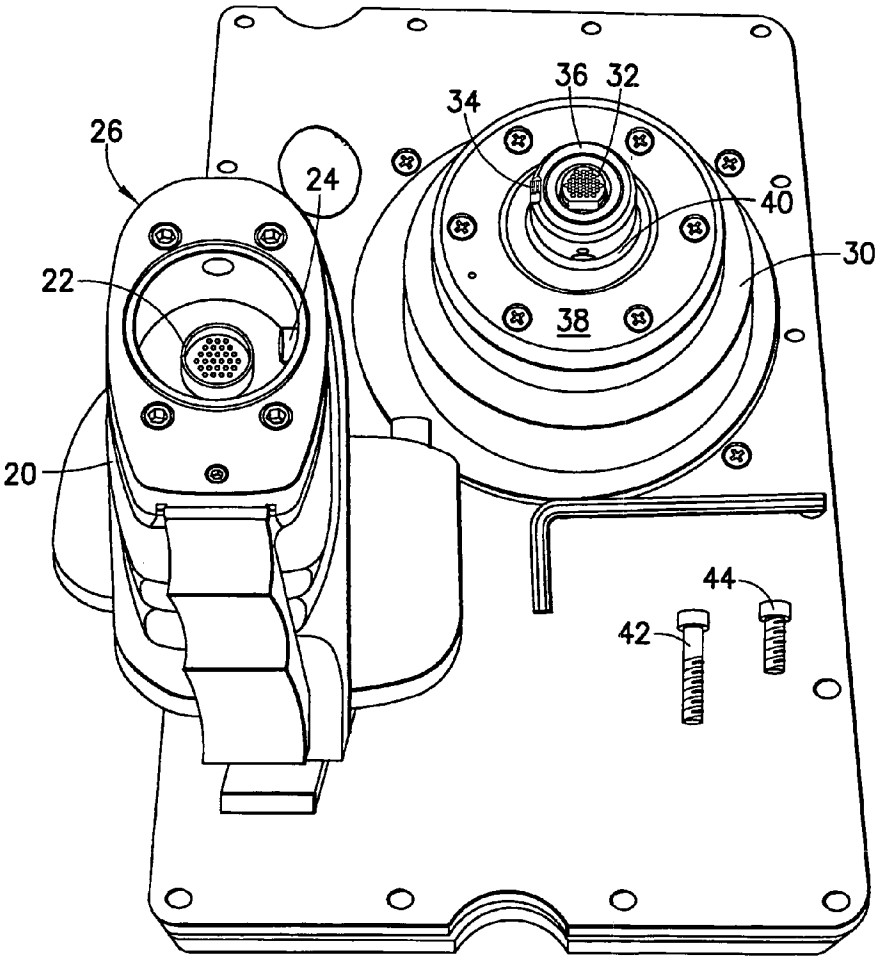
FIG. 2 is a top view of grip, base and seal components of the reconfigurable control of FIG. 1.
Figure 3:
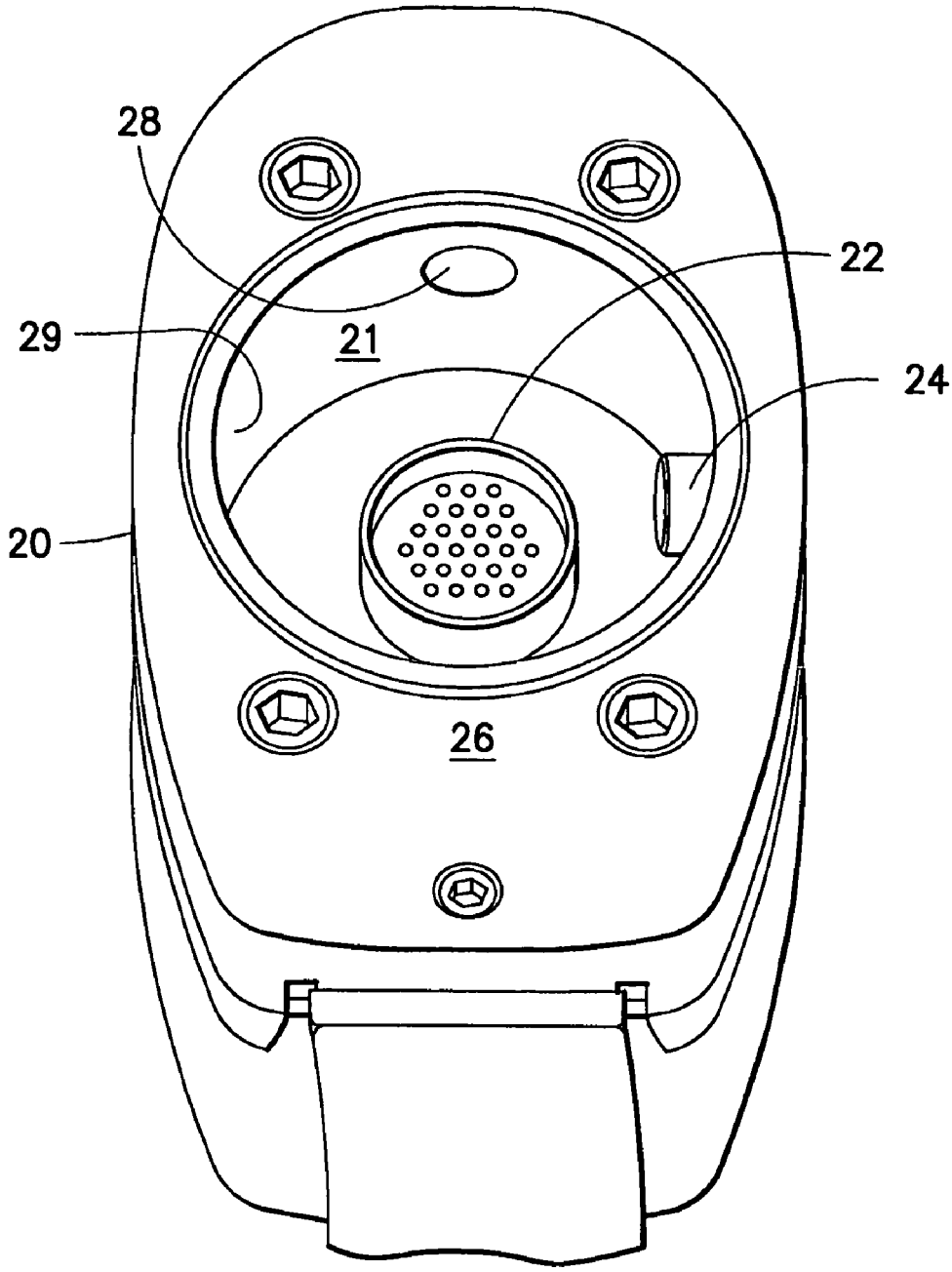
FIG. 3 is a top view, focusing upon a lower surface, of the grip of the reconfigurable control of FIG. 1.
Figure 4:
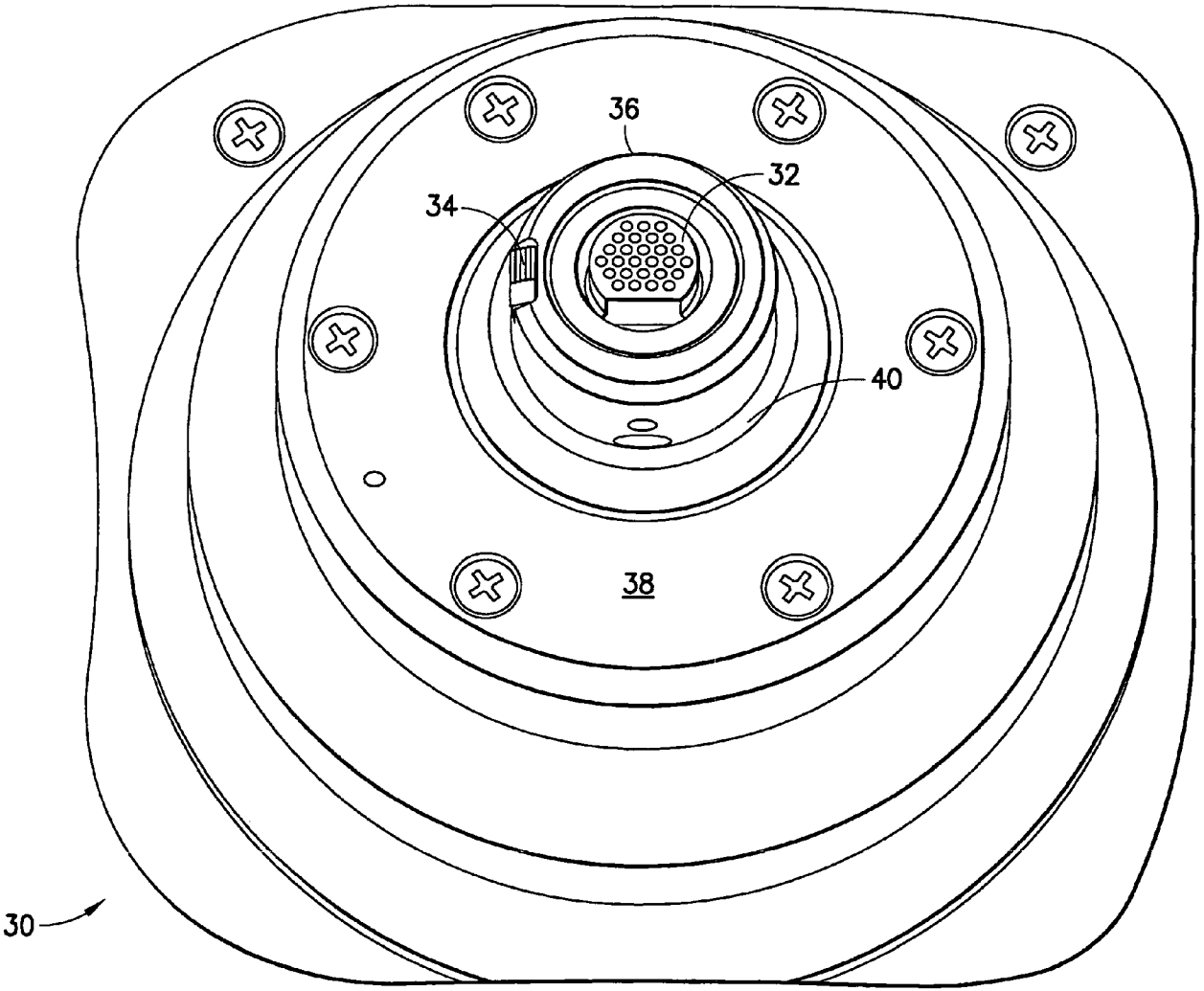
FIG. 4 is a top view of the base and the seal of the reconfigurable control of FIG. 1.

As shown more particularly at FIGS. 2 and 4, the base 30 of the controller 10 includes a shaft 36 having a mating electrical connector 32 such as, for example, a female socket connector, for receiving electrical connector 22 and a keyway slot 34 for accepting the orientation pin 24 disposed in the grip 20. In an installed position (shown in FIG. 1), the shaft 36 of the base 30 is disposed within a chamber 21 of the grip 20 such that a lower surface 26 of the grip 20 is substantially coplanar with an upper surface 38 of the base 30. Preferably, the grip 20 is secured to the shaft 36 of the base 30 by two (2) screws 42 and 44 disposed in holes 28 and 29 located about ninety degrees (90°) apart and accessible from the lower surface 26 of the grip 20. An "O"-ring 40 (FIG. 4) is disposed about the shaft 36 and seals the lower surface 26 of the grip 20 and the upper surface 38 of the base 30 to prevent dust, dirt and other contaminants of harsh environmental conditions of combat from invading the chamber 21 and damaging or otherwise rendering mechanical and electrical components of the controller 10 inoperable. In addition to acting as an environmental seal (as described above), the o-ring 40 substantially eliminates noise vibration rattle (N.V.R. as is known in the art) by facilitating a compression fit of the grip 20 to the base 30. In one embodiment, the o-ring 40 is comprised of a polymer or copolymer rubber such as, for example, polyacrylate, neoprene, or an isoprene and isobutylene copolymer.

The inventors have realized that by employing detachable electrical connections (e.g., male connector 22 in the grip 20 and female connector 32 in the base 30) the combat controller 10 is reconfigurable for expanding mission requirements. For example, not all of the pins and mating slots of the connectors 22 and 32 may correspond to specific features and functions of an apparatus under control (e.g., the combat vehicle and/or systems deployed thereon). As new features, functions and/or equipment is added, available pins and slots may be assigned to actuate these new mission requirements. Ultimately, such flexibility in responding to new mission requirements will result in saving to customers since the reconfigurable combat controller 10 is adaptable and need not be disassembled and re-wired to meet the new requirements. It can also be appreciate that maintenance activities may be performed more readily. For example, damaged or inoperable grips 20 may be detached from the base 30 and immediately replaced with a new grip. As such, the combat vehicle can be more easily and quickly returned to active duty status minimizing vehicle down time. Accordingly, the combat controller 10 is reconfigurable as it includes additional electrical connections for future expansion of mission capabilities. Such capabilities may include, for example, adding a weapon system to the combat vehicle such as a tow missile system, or a new shape or design of a grip made, for example, to accommodate a modification to the vehicle cockpit which alters an envelope available for the footprint of the combat controller 10. As described herein, the inventive reconfigurable combat controller 10 can readily accommodate such new and expanded mission requirements.

While the inventive reconfigurable combat controller 10 has been described and illustrated in connection with preferred embodiments, many variations and modifications, as will be evident to those skilled in this art, may be made without departing from the spirit and scope of the invention. The invention is thus not to be limited to the precise details of methodology or construction set forth above as such variations and modification are intended to be included within the scope of the invention.

What is claimed is:

1. A reconfigurable control for a combat vehicle, comprising:

a grip having a lower surface and a chamber extending from said lower surface, said grip including a first electrical connector and a key disposed in said chamber;

a base having an upper surface and a shaft extending from said upper surface, said shaft including a second electrical connector for receiving said first electrical connector and a keyway slot for receiving said key; and a seal disposed about said shaft;

wherein when in an installed position, said shaft of said base is disposed within said chamber of said grip such that said lower surface of said grip and said upper surface of said base are substantially coplanar, said first electrical connector electrically engages said second electrical connector and said key mechanically engages said keyway slot, and wherein said seal forms a compression fit of said grip to said base for sealing said chamber such that at least one of contaminants are substantially prevented from entering said chamber and rendering mechanical and electrical components of said controller inoperable and noise vibration rattle is substantially eliminated.

2. The reconfigurable combat control of claim 1, wherein said first electrical connector is comprised of a male electrical connector and said second electrical connector is comprised of a mating, female connector.

3. The reconfigurable control of claim 2, wherein said male connector is comprised of a 0.050 mil pitch, pre-wired "D" circular pin connector having a plurality of pins and said female connector is comprised of a socket connector having a corresponding plurality of sockets.

4. The reconfigurable control of claim 1 wherein said key is located to facilitate orientation of said grip in said base and to substantially inhibit, once mounted in said installed position, rotation of said grip independently from said base.

5. The reconfigurable control of claim 4, wherein said key is comprised of a dowel pin press fit within said chamber.

6. The reconfigurable control of claim 5, wherein said seal is comprised of an o-ring seal.

7. The reconfigurable control of claim 1, wherein said grip is secured to said shaft of said base by a plurality of fasteners disposed in holes located about ninety degrees (90°) apart and accessible from said lower surface of said grip.

8. A reconfigurable control for a combat vehicle, comprising:

a grip having a first surface and a chamber extending from said first surface, said grip including a first electrical connector and a key disposed in said chamber;

a base mounted in said combat vehicle, said base having a first surface and a shaft extending from said first surface, said shaft including a second electrical connector for receiving said first electrical connector and a keyway slot for receiving said key; and a seal disposed about said shaft;

wherein when in an installed position, said shaft of said base is disposed within said chamber of said grip such that said first surface of said grip and said first surface of said base are substantially coplanar, said first electrical connector electrically engages said second electrical connector and said key mechanically engages said keyway slot, and wherein said seal forms a compression fit of said grip to said base for sealing said chamber such that at least one of contaminants are substantially prevented from entering said chamber and rendering mechanical and electrical components of said controller inoperable and noise vibration rattle is substantially eliminated.

* * * * *

UNITED STATES PATENT AND TRADEMARK OFFICE

CERTIFICATE OF CORRECTION

PATENT NO. : 7,271,796 B1
APPLICATION NO. : 10/900564
DATED : September 18, 2007
INVENTOR(S) : Robert E. Moll et al.

It is certified that error appears in the above-identified patent and that said Letters Patent is hereby corrected as shown below:

On the title page, at (73) Assignee, "Ultra Electronics Measurement Systems, Inc., Wallingford, CT (US)"

should read --Measurement Systems, Inc., Fairfield, CT (US)--.

Signed and Sealed this

Twenty-first Day of September, 2010

David J. Kappos

David J. Kappos
*Director of the United States Patent and Trademark Office*